United States Patent [19]

Ubukata et al.

[11] 4,454,493

[45] Jun. 12, 1984

[54] HERMETICAL TYPE THERMALLY RESPONSIVE SWITCH

[75] Inventors: Susumu Ubukata, 549 Nakasuna-cho,, Tenpaku-ku, Nagoya, Japan; Yasukazu Mizutani; Syozo Iyoda, both of Nagoya, Japan

[73] Assignee: Susumu Ubukata, Nagoya, Japan

[21] Appl. No.: 420,006

[22] Filed: Sep. 20, 1982

[51] Int. Cl.[3] ..... H01H 37/54

[52] U.S. Cl. ..... 337/368; 337/374; 337/381

[58] Field of Search ..... 337/342, 343, 347, 349, 337/360, 365, 368, 374, 380, 381

[56] References Cited

U.S. PATENT DOCUMENTS 3,530,419 9/1970 Hire ..... 337/368 X 3,587,022 6/1971 Hire ..... 337/368 X 4,376,926 3/1983 Senor ..... 337/368 X

*Primary Examiner*—George Harris

*Attorney, Agent, or Firm*—Carroll F. Palmer

[57] ABSTRACT

In a hermetic type thermally responsive switch comprising a fixed contact support having a fixed contact at its end and cantilever disposed in a hermetically sealed vessel, a elongated support supporting a thermally responsive disk which has a movable contact and cantilever disposed in said vessel through a connecting means; said fixed contact support comprises laminated metallic sheets each having different elastic modulus, while a spacer means is interposed in electrically, thermally insulated relationship between said elongated support and said connecting means so as to calibrate the snap temperature of said disk.

6 Claims, 9 Drawing Figures

HERMETICAL TYPE THERMALLY RESPONSIVE SWITCH

BACKGROUND OF THE INVENTION (1) Field of the Art

This invention relates to a thermally responsive switch having a thermally responsive element enclosed in a hermetically sealed vessel, said thermally responsive element being warped for snap action in response to ambient temperature.

A thermally responsive switch of this type thus far introduced, comprises a fixed contact disposed in a hermetically sealed vessel and a movable contact secured to a thermally responsive disk disposed in said vessel, with the disk being of bi- or tri-metallic element. Said switch is, for example, embedded into the winding of an electric motor with the disk in series with the winding. At the time of overloaded condition, the disk snaps to separate the movable contact from the fixed contact so as to interrupt the motor circuit for protection in response to the temperature rise owing to abnormally increased current flowing through the motor.

In so doing, said fixed contact support is in cantilever relationship with the vessel. Such is the construction that the fixed contact support has a tendency to bounce when the movable contact is brought into engagement with the fixed contact upon the moving-back action of the disk. The bounce thus induced allows both the contacts to be exposed to welding force caused by arcing. As a result, the contacts suffer from undesirably large quantity of consumption loss.

Further, it is important to insure a short response time for the disk to snap when its temperature reaches a predetermined value in protecting appliances to be protected against overcurrency.

In addition, it is necessary to maintain uniform response time in spite of having a means to adjust ultimate trip current value.

SUMMARY OF THE INVENTION

A first object of the invention is to provide a hermetic type thermally responsive switch which is compact and capable of preventing a fixed contact support from bouncing when a movable contact engages a fixed contact upon the moving-back action of a thermally responsive element. Accordingly, the invention provides a hermetic type thermally responsive switch which is capable of curbing welding force from being induced between contacts and eventually reducing consumption loss of the contacts.

A second object of the invention is to provide a hermetic type thermally responsive switch which substantially maintains a short response time of its thermally responsive element in spite of having a means to adjust the ultimate trip current value.

To achieve the first object, a fixed contact support placed in a hermetic vessel is comprised of composite laminated metallic sheets each having different elastic modulus. Such is the structure that the support is curbed from bouncing when the movable contact is brought into engagement with the fixed contact upon the moving-back action of the element.

On the other hand, to achieve the second object, the thermally responsive switch carries a connecting means secured between a thermally responsive element and on elongated support supporting the element, and a space determiner secured between the connecting means and the support so as to adjust point pressure of the contacts which governs snap temperature of the element. The space determiner is constructed so as to thermally and electrically insulate between the connecting means and the support. Such is the configuration that the space determiner avoids current flowing through the connecting means from being bypassed. As a result, effective Joule heat is generated at the connecting means, while heat generated from the thermally responsive element is deterred from moving toward the support, so that the short responsive time of the element is maintained.

Other and further objects, features and advantages of the invention will be apparent more fully from the following description.

DETAILED DESCRIPTION OF THE INVENTION

Figure 1:
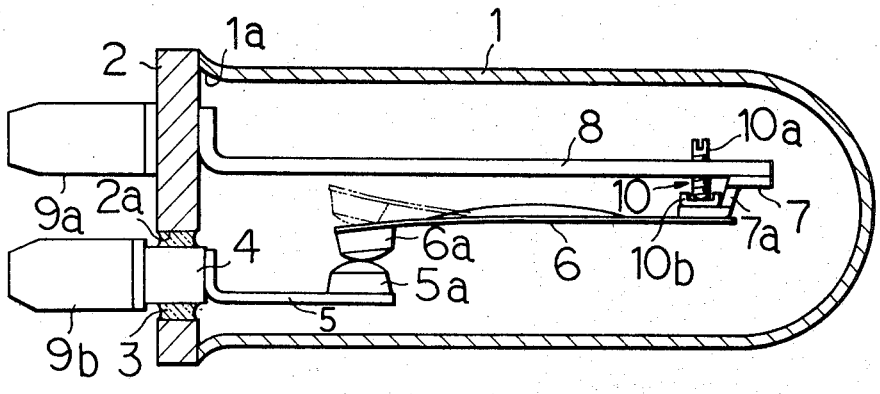
FIG. 1 is a longitudinal sectional view showing a thermally responsive switch according to a first embodiment of the invention.
Figure 3:
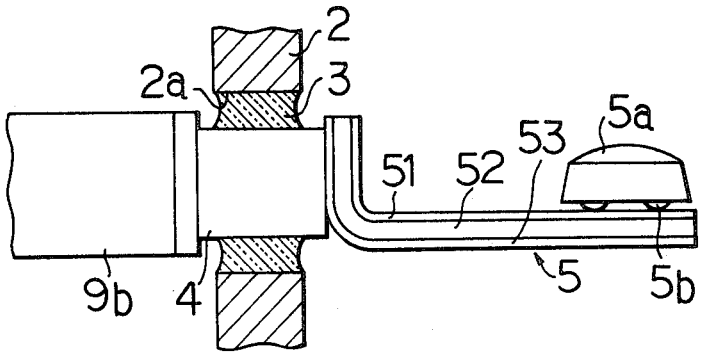
FIG. 3 is partly enlarged sectional view of a portion of FIG. 1.

Referring to FIG. 1, a vessel designated by the numeral 1 is formed from an iron sheet by means of drawing to have open left end 1*a* as depicted, a circular lid plate 2 formed form, for example, an iron sheet by means of stamping is hermetically secured to the open end 1*a* by means of ring projection welding or the like. The lid plate 2 has aperture 2*a* to which an electrically conductive column-shaped terminal pin 4 is air-tightly secured in electrically insulated relationship with the plate 2 by means of glass sealant 3 or the like. The portion of the terminal pin 4 positioned outside from the vessel 1 has a connector 9*b* adapted to be connected to power supply source or appliance to be protected. While the other portion of the pin 4 positioned inside of the vessel 1 has a fixed contact support 5 having a silver-alloy clad semi-spherical fixed contact 5*a* at its end. Said support 5, as shown in FIG. 3, is comprised of a composite material, that is, three metal sheet layers unseparably laminated to each other, both the upper and lower layers 51, 53 are of iron: the middle layer 52 being of copper. In this situation, the lower part of said fixed contact 5*a* has projections 5*b* welded to the upper layer 51 of the support 5. The portion of the lid plate 2 facing the interior of the vessel 1 has an L-shaped metallic support 8 cantilever mounted by means of welding or the like. To the free end of said support 8 is one end of a crank-shaped metallic connecting means 7 secured, the other end of which being secured to the peripheral end of a thermally responsive disk 6.

The disk 6 comprises bi- or tri-metallic element formed into centrally concave-shaped configuration, and has a movable contact 6a remote from the connecting means 7 so as to be in registeration with the fixed contact 5a.

The disk 6 is adapted to warp with snap action from the solid line position to the dotted line position so as to separate the movable contact 6a from the fixed contact 5a at the temperature of, for example, 120° C., and move back from said contact open position to the solid line contact closed position when the temperature falls to, for example, 80° C. as seen in FIG. 1. Between the support 8 and the disk 6 is a space determiner 10 which comprises a screwed stud 10a and an insulator 10b fixed to the stud 10a. The stud 10a is driven into the screwed hole (not shown) formed in the free end of the disk 6, while the insulator 10b made from, for example, aluminous procelain engages with the end of the connecting means 7.

In this situation, turning the stud 10a in one direction or another allows the width portion 7a of the means 7 to deform to different degrees for the reason that the insulator 10b pushes the connecting means 7 with different forces in magnitude, thus allowing the point pressure between contacts 5a, 6a to change. This makes it possible to adjust the point pressure so as to ensure the snap action of the disk 6 upon calibrating the ultimate trip current value as described hereinafter in detail.

Incidentally, it is noted if the stud 10a is made from an electrically insulating material, the insulator 10b may, of course, be eliminated.

Reverting to the lid plate 2 of FIG. 1, another connector 9a is attached to the outer surface of the lid 2 by means of welding or the like.

With the structure thus far described, it may be apparent that an operator should connect the switch in series with, for example, an electric motor, and at the same time, connectors 9a, 9b to a power supply source with the switch installed in thermally exchangeable relation to the winding of the motor.

As a consequence, the current flows from the support 8 through the connecting means 7, the thermally responsive disk 6, the movable contact 6a, the fixed contact 5a, and the fixed contact support 5 to the terminal pin 4, while the switch is subjected to the heat generated by the winding. In so doing, the temperature of the disk 6 rises due to the heat from the members noted above causing the disk 6 to snap to the dotted line contact open position so as to interrupt the motor circuit, thus protecting the winding of the motor against abnormal temperature rise.

Note that the support 8 is secured to the lid plate 2, while the support 5 is secured to the pin 4 as seen FIG. 1, but alternatively, the support 8 may be secured to the pin 4, while the support 5 is secured to the lid plate 2.

The thermally responsive disk 6, as stated hereinbefore, snaps and moves back at the predetermined temperatures, however, the movable contact 6a, may for short periods of time, bounce against the fixed contact 5a when the former engages the latter.

General theory shows that usual contact closed condition unavoidably accompanies slight welding between the contacts owing to the intensive current flowing through microscopic projections presented on the surface of the contacts. Taking this theory into consideration, if the movable contact 6a bounces the contacts are subjected to additional welding because of the repeated arcing between the contacts and the intensive current flowing through the microscopic projections, thus resultantly increases consumption loss of contacts.

Now, the dimension of the switch according to the embodiment is as follows:

The switch is a little smaller than half the scale of the illustration, the fixed contact support 5 being 12 mm long, 4.5 mm wide with both the upper and lower layers 0.2 mm thick, the middle layer 52 being 0.4 mm thick. The contact 5a is 6 mm in diameter with the projecting 5b being 3.8 mm in diameter. The thermally responsive disk 6 is, as described hereinbefore, formed into central concave-shaped configuration by means of stamping from a bi-metallic sheet of 26 mm long, 14.5 mm wide and 0.25 mm thick. In the meanwhile, the point pressure exerting against the contact 5a from the contact 6a is substantially 100 gram, the magnitude of which being tantamount to slight displacement (about 0.1 mm) at the end of the support 5. Apparently a larger quantity of the displacement than that occurs though, when the disk 6 moves back to bring the contact 6a into engagement with the contact 5a, however, the allowable maximum displacement is previously designed to be within elastic limit of the support 5. When the engagement between the contacts occurs, the support 5 is allowed to resiliently deflect, although extremely slightly, in timed relationship with the moving-back action of the disk 6 to alleviate the impact between said contacts.

The following is the method of ascertaining whether the welding between contacts is present or not, 65 amp current is supplied to the switch through the connectors 9a, 9b from a constant current power supply with the switch installed in 25° C. atmospheric temperature.

And the contacts 5a, 6b are repeatedly on-off actuated in combination with the consecutive snap action of the disk 6.

In so doing, the on-sustained and off-sustained times are counted to measure each deviation of both these times. The extent of the deviation, of course, depends upon the magnitude of welding.

Actually the count of the on-sustained and off-sustained times is first begun after the disk 6 snaps and moves back 10 times to accommodate itself to the atmospheric temperature.

Figure 2:
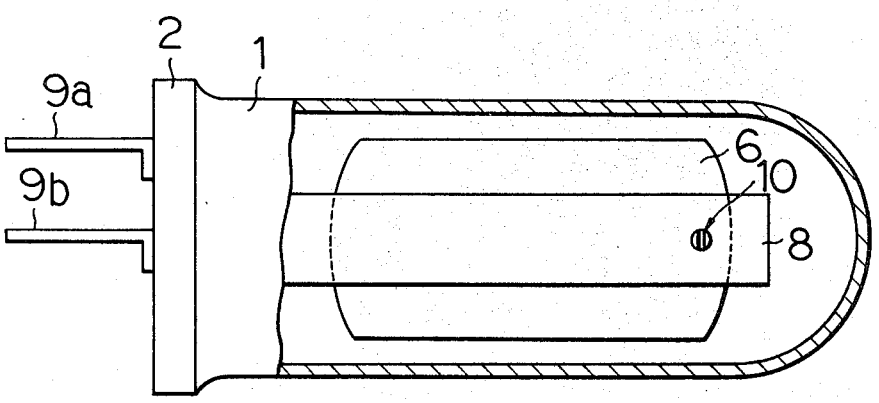
FIG. 2 is the plan view of a thermally responsive switch but partly broken away.
Figure 8:
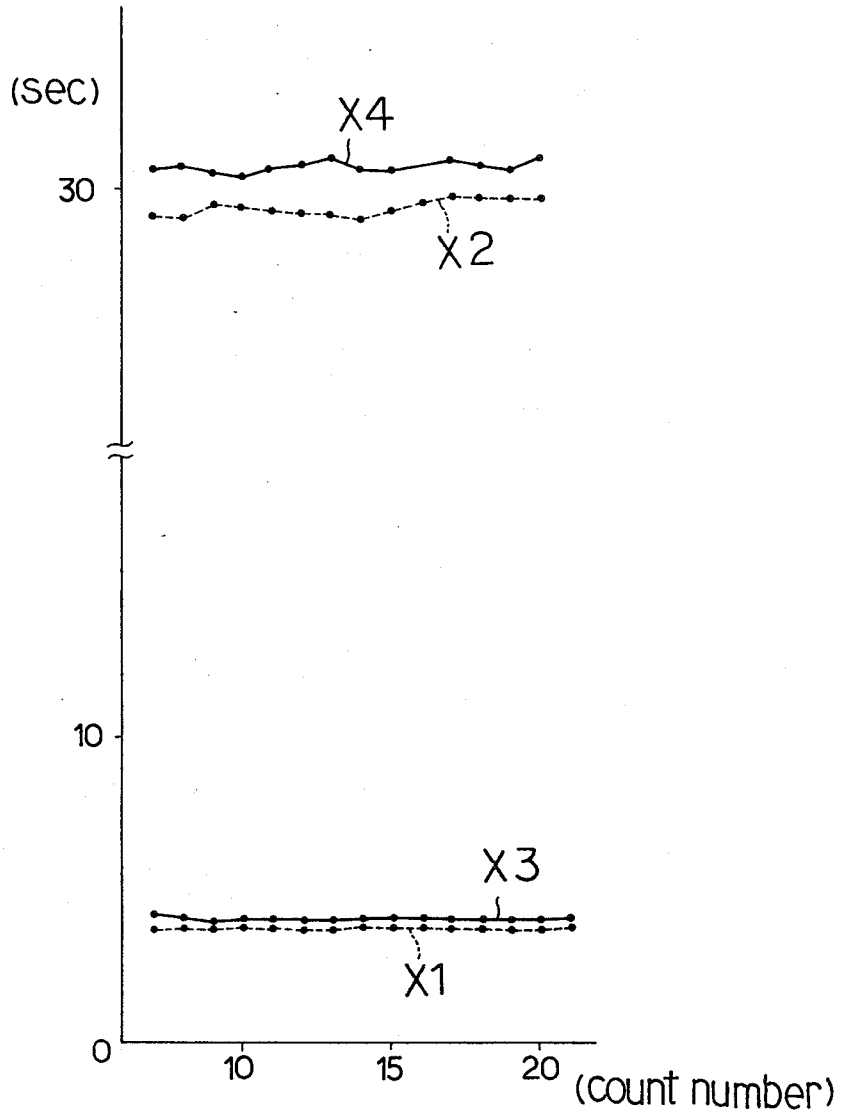
FIG. 8 is a characteristic curve of a thermally responsive switch of the invention.
Figure 9:
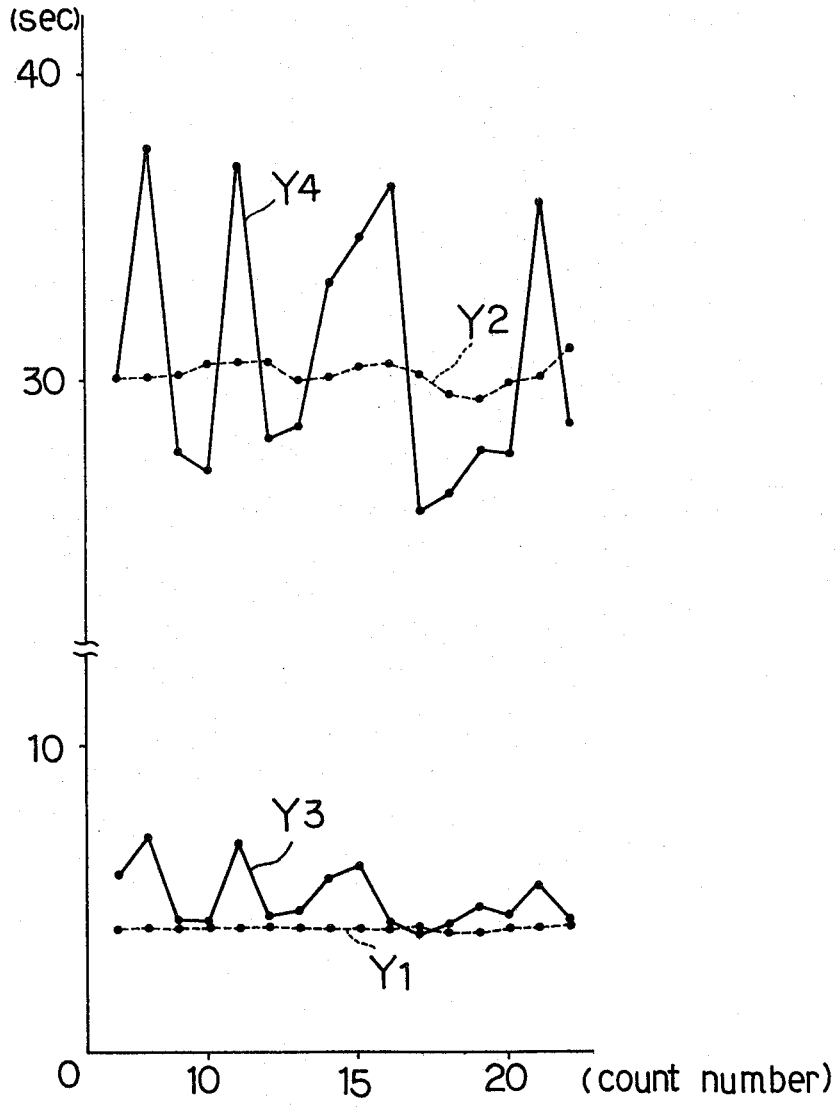
FIG. 9 is curve similar to FIG. 8 according to a prior art thermally responsive switch.

Now, FIGS. 8 and 9 show the experimental results obtained from the above measurements in which FIG. 8 is for a thermally responsive switch in accordance with the invention of FIGS. 1 through 3, while FIG. 9 is for a prior art switch similar to this invention except for that a fixed contact support is made of a phosphor bronze piece. In FIGS. 8 and 9, axis of ordinates is on- and off-sustained times (sec) between the contacts 5a, 6a while axis of abscissa are on-off counted number between the same. Accordingly, curves represented by X1, Y1, of the graphic illustrations show the on-sustained time, while curves by X2, Y2 show the off-sustained time when the presently embodied switch and a prior art switch are respectively energized with low voltage (5 V) a.c. source. In the meanwhile, curves expressed by X3, Y3 show the on-sustained time, curves by X4, Y4 being off-sustained time when said switches are energized with high voltage (18 V) d.c. source.

The following is the discussion of contact "bouncing phenomenon".

As seen at X3, X4 of FIG. 8, the on-sustained time is within the boundary of 5–5.4 (sec), while the off-sustained time being within the boundary of 30.3–30.5 (sec) with the on-off counted number from 10 to 20.

Contrary to that, in the prior art in which a fixed contact support comprises phosphor bronze, the on-sustained time is within the boundary 4.2–6.8 (sec), while off-sustained time being within the boundary of 25.8–36.9 (sec) as seen at Y3, Y4 of FIG. 9 with the number of count from 10 to 20.

As readily understood from the foregoing description, the more extensive deviation is found within the boundary of 25.8–36.9 (sec) in the prior art compared to the present invention.

Incidentally, a fixed contact support made from other material than phoshpor bronze, for example, iron metal sheet, shows an extensive deviation similar to that of the phosphor bronze as a result of the experiment.

In the meanwhile, the observation of the on-off actuation between contacts through C.R.T. display shows that if a fixed contact support is made from composite material, the bouncing attenuates in shorter periods of time. If the phenomenon in which the bouncing is shortly attenuated is termed as anti-bounce effect for the sake of convenience, further investigation indicates that the anti-bounce effect involves in elastic modulus (Young's modulus), namely the anti-bounce effect is strengthened in line with the increase of difference between elastic modulus of the metallic layers.

By way of example, the elastic modulus are 12,000 $Kg/m^2$ for copper, 21,000 $Kg/m^2$ for iron and 1600 $Kg/m^2$ for lead.

If lead metal is employed for the support 5 instead of copper, the anti-bounce effect will be further enhanced due to the large difference between the elastic modulus.

In this way, properly selective combination of materials renders more improved anti-bounce effect when no problem is compounded with electrical resistance and heat resistivity taken into account.

Note that instead of three-laminated layer, two-laminated layer is, of course, effective in thwarting the bouncing, and further increased number of laminations will expectantly bear more advantageous effects in abstaining the bouncing.

In addition, the layer may be of alloy, to say briefly, the anti-bounce effect is obtained so long as each of layers has different elastic modulus, so that the contacts are deterred from welding to each other. It is appreciated that so long as elastic modulus of one layer is 1.2–1.3 times as large as that of another layer, a practical anti-bounce effect is obtained.

Now, generally a thermally responsive switch has ultimate trip current value (referred to U T C hereinafter) and short time trip (referred to S/T hereinafter) as a characteristic required in protecting devices such as an electric motor. The S/T is an elapse time spent to actually open the contacts when the temperature reaches high enough to snap the disk 6 when the current a few times as intensive as the U T C is supplied.

As is well known the U T C must be accorded with the rated load current of the motor. If the U T C is smaller than the rated load current, the operability of the motor reduces due to the frequently repeated warping action of the disk. To the contrary, if the U T C is, say 1.5 times higher than the rated load current, there is a hazard that the insulation of the winding deteriorates owing to the heat generated especially in case where the motor is in overloaded condition.

In consequence, the U T C is determined within the boundary of 105–125 percent of the rated load current.

Secondly, when a loaded torque is applied to the motor, the rotor is in the locked condition, while current a few times as intensive as the rated current flows through the winding. In this situation, a prompt interruption of current supply is necessary to protect the winding against overheat. This involves the characteristic of the S/T of the thermally responsive switch. It is necessary to determine each dimension and resistance value of the assembly members of the switch in a bid to accord the U T C with the rated load current of the motor, while considering the mechanical strength of the members. To merely determine the U T C in a manner stated above is relatively easy. However, a short S/T is a requirement since the winding of the motor is vulnerable to overload current (at the time the rotor is locked). This signifies that to shorten the S/T without altering the U T C is desired.

Investigation shows that a member providing high ratio of resistance to the total resistance (total resistance between the connectors *9a, 9b*) must be a disk in obtaining a short S/T. Subsequently, it has been found that relatively high resistivity is required for the connecting means 7 so as not to release the heat of the disk 6 through thermal conduction. A connecting means of high resistivity effectively intercepts thermal transfer from the disk 6 to the support 8. In consequence, the resistivity of the means 7 depends upon the magnitude of the S/T.

The measurement of the U T C is carried out as follows: A thermally responsive switch is placed in an atmosphere having a temperature of 60 deg.C and allowed to adjust to that temperature. Then current is supplied to the switch through the connectors *9a, 9b*. The current value is adapted to be intensified by one ampere per ten minutes, and read when contacts open.

On the other hand, the measurement of the S/T is as follows: The same switch is placed into a constant temperature bath of 25° C. to accommodate itself to the atmosphere. Then 60 ampere current is supplied to the switch through the connector *9a, 9b*.

And the time spent until the contacts open when energized, is counted.

The specimens subjected to the measurement are as follows: One is a presently embodied switch seen in FIG. 1, another being a prior art switch similar to that except that a space determiner comprises a screw means made from brass metal.

In the switch disclosed here, 2.5 (mΩ) is the totaled resistance in which 1.2 (mΩ) being for the disk 6; 0.3 (mΩ) each for the connecting means 7 and the supports 5, 8; 0.2 (mΩ) each for the terminal pin 4 and the contacts *5a, 6a* including their point resistance.

In the prior art switch, 2.5 (mΩ) is the totaled resistance in which 1.2 (mΩ) being for a disk; 0.01 (mΩ) for a connecting means 0.59 (mΩ) for an elongated support; 0.3 (mΩ) for a fixed contact support; 0.2 (mΩ) each for a terminal pin and contacts including their point resistance. The experimental results show that the U T C is 34.5 ampere and the S/T being 12 seconds for the switch presently embodied, while the former is 34.3 ampere; the latter being 16 seconds for the prior art switch.

This signifies that the S/T is shortened by 25 percent compared with that of the prior art to effectively protect the motor against the hazardous temperature rise at the time of overloaded condition.

The description thus far conducted is why high resistivity is required for a connecting means to obtain a short S/T among the totaled resistance between the connectors 9a, 9b. However, one of the objects of the invention resides in providing a structure which is capable of calibrating snap temperatures, while maintaining the advantage of the connecting means 7.

With the structure thus described, the gap adjustment between the support 8 and the connecting means 7 by means of the space determiner 10, permits adjusting the temperature at which the movable contact 6a separates from the fixed contact 5a. In this situation, the connecting means 7 generates enough heat, while regulating thermal release from the disk 6 to the support 8 for the reason that the space determiner 10 is electrically, thermally insulated, and thus allows a short length of S/T with substantially uniform U T C.

Figure 4:
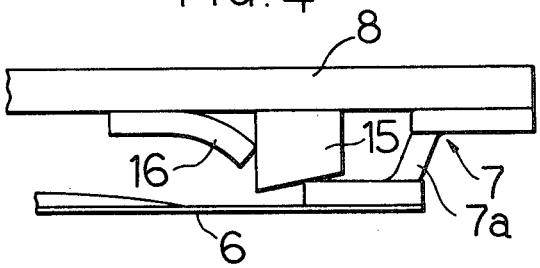
FIG. 4 is a partly enlarged side elevational view showing a thermally responsive switch according to a second embodiment of the invention.

It is noted that instead of the space determiner 10 shown in FIG. 1, a space determiner may constructed as illustrated in FIG. 4. Thus, a wedge-shaped space determiner 15, made of insulating material such as a procelain or the like, is interposed between the connecting means 7 and the support 8, and said determiner 15 being horizontally slidable relative to support 8. A generally arcuate arm 16 is attached at its end to the support 8 by means of welding or the like and at its other end to the determiner 15.

Figure 6:
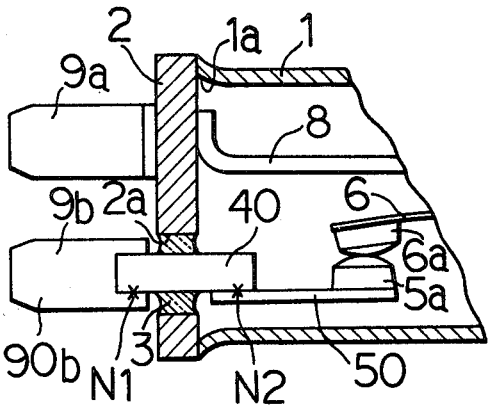
FIG. 6 is a lateral, fragmentary sectional view showing a prior art thermally responsive switch.

In FIG. 6, a column-shaped terminal pin 40 is attached to the aperture 2a by means of the glass sealant 3.

Figure 7:
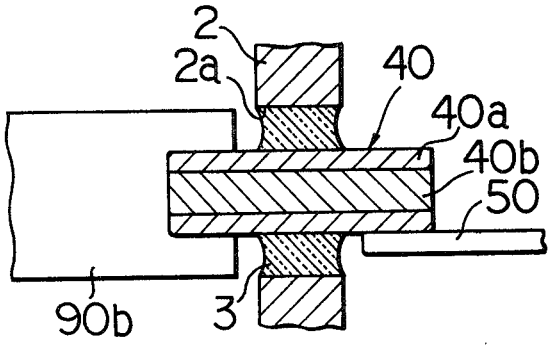
FIG. 7 is an enlarged lateral, fragmentary sectional view showing a terminal means and its periphery of FIG. 6.

To the exterior end of the pin 40 from the vessel 1 is a connector 90b spot welded at N1, while to the interior end of the pin 40 from the vessel 1 is a fixed contact support 50 spot welded at N2. Said terminal pin 40 is, as seen in FIG. 7, a composite metallic bar consisting of an outer cylinder 40a and an inner column 40b, the cylinder 40a is made from nickel-ferrous alloy with nickel ingredient some ten percent while the column 40b being from copper, and said cylinder 40a and column 40b are tightly attached to each other by means of hot or cold roll. The glass sealant 3 is of soda-containing glass, for example, soda-lime glass, the terminal pin 40 being of nickel ferrous alloy having thermal expansional coefficient smaller than that of the sealant 3.

In this situation, the lid plate 2 is placed into a furnace of about 1000° C., so that the sealant 3 is sufficiently molten to present wetting condition between the pin 40, the sealant 3 and the aperture 2a. Lowering the lid plate 2 to the normal temperature allows hermetically sealed condition between said pin 40, the sealant 3 and the aperture 2a as is well known. In this condition, the sealant 3 air-tightly engages the terminal pin 40 by its strong contraction. For this reason, the pin 40 is somewhat smaller than the sealant 3 in coefficient of thermal expansion. To suffice the above requirement, the nickel ferrous alloy is most compatible for the terminal pin 40.

However, the nickel ferrous alloy is 30–50 times greater than copper in electrical resistance, and generates heat when energized, which is not preferable. For the reason of curbing the heat thus generated from the alloy, the terminal pin 40 is made of so-called clad material, that is, copper metal clad by cylindrical nickel ferrous alloy as described hereinbefore. But, such clad material as nickel ferrous alloy generally has such bad machinability that multiple machining processes are needed, thus being prohibitively costly. Also, a lot of care must be taken to check on the air-tightness between the copper metal and the alloy on the production line.

The present invention includes a provision of a novel mounting structure which obviates the above drawbacks; that is, a terminal pin is made of nickel ferrous alloy without using clad material, while maintaining the electrical resistances of the elements not more than the same level of the prior art while securing sufficient strength of the elements. For this purpose, the electrical resistance values of the mounting structure involving the terminal pin, is measured to discuss the measurements.

By way of example, the dimensions and electrical resistance values involving the prior art terminal pin 40 are as follows: 1.6 (mm) in diameter is the central copper 40b; 3.2 (mm) in diameter is the nickel ferrous alloy 40a; 9 (mm) long is the distance between N1 (nugget portion) and N2 (nugget portion). While, 0.24 (mΩ) is the electrical resistance of the alloy between N1 and N2; 0.077 (mΩ) is the electrical resistance of the copper 4b between N1 and N2. The above measurements show that 0.24 (mΩ) of the alloy 40a is greater compared with 0.077 (mΩ) of the copper 4b, and 0.163 (mΩ) is the resistance from the portion N1 (N2) to the copper 40b through the thickness dimension of the alloy 40a.

On the other hand, the mounting structure involving a terminal pin according to the invention, is on the basis of the following fact: In a thermally responsive switch of the sort, it has not been contemplated at all to, for example, weld the members to the ends of the pin by means of surface-to-surface contact since there is a risk that the hermetically sealed portion of the pin may be thermally damaged to lose air-tightness at the time of welding. However, experimental results show that if the diameter of the pin 4 is predetermined longer than the mounted portion of the pin 4 to the sealant 3, and the total length of the pin 4 is not more than twice as great as the diameter of the pin 4, the members such as a connector and a fixed contact support may be attached to both ends of the pin 4 by means of surface-to-surface contact.

Dimensions and electrical resistances of the mounting structure of the terminal pin 4 are as follows: 3.5 (mm) long is the total length of the pin 4; 3.8 (mm) is the diameter of the pin 4. 0.22 (mΩ) is the electrical resistance between the mounting surface of the connector 9b and that of the fixed contact support 5 including their thickness seen FIG. 1. 0.22 (mΩ) measured as above signifies the surface-to-surface contact is advantageous considering that the resistance of the above mounting surfaces are slight 0.04 (mΩ) since that of the pin 4 is 0.18 (mΩ). In this situation, the connector 9b and the fixed contact support 5 are identical to those of the prior art in dimension and material.

The invention thus far described provides an inexpensive and quality-wise switch because a costly clad material is eliminated with the amount of a nickel ferrous alloy reduced, while the elimination of the clad material is free from the air-tightness problem between a copper metal and a nickel ferrous alloy. The pin of relatively short length lessens the projecting length of the support 5 from the lid plate 2, thus permitting the vessel 1 to be short in depth so as to be of compactness as a whole.

Figure 5:
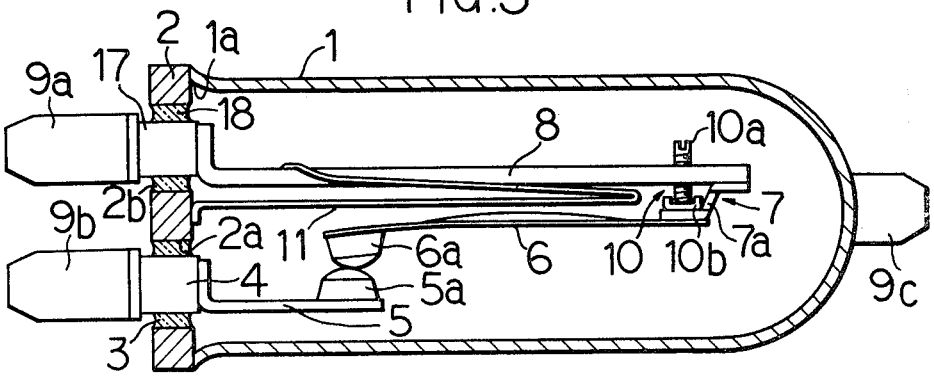
FIG. 5 is view similar to FIG. 1 according to a third embodiment of the invention.

By way of illustration in which a third terminal pin is added to FIG. 1 as described in FIG. 5 which depicts a third embodiment of the invention. In FIG. 5, a U-shaped filament 11 is attached at one end to the elongated support 8 and at other end to the lid plate 2, while another connector 9c is attached to the closed end of the vessel, and the support 8 being attached to a terminal pin 17. Said terminal pin 17 is secured to the aperture 2*b* by means of glass sealant 18 in the manner similar to the terminal pin 4. With the structure, across the connectors 9*c* and 9*a*, is the auxiliary winding of the motor connected, so that the disk 6 will snap promptly with the assist of the hot filament 10 at the time of abnormal conditions.

Note that operation and other reference numerals of the parts are identical to FIG. 1, therefore the detailed description is omitted.

It is to be understood that variations and modifications of the present invention may be made without departing from the scope thereof. It is also to be understood that the present invention is not to be limited by the specific embodiments disclosed herein but only in accordance with the appended claims when read in light of the foregoing specification.

What is claimed is:

1. In a hermetic type, thermally responsive switch including a cup-like vessel hermetically sealed by a cap, a fixed contact carried upon the free end of a first cantilever support disposed in said vessel, an elongated, second cantilever support disposed in said vessel, the fixed ends of said first and second cantilever supports being positioned at the same end of said vessel, a thermally responsive, disk-like element carried at one end by said second cantilever support and having on the other end a movable contact to engage with and disengage from said fixed contact when snapped by said disk-like element in response to temperature changes, the improvement which comprises having said first cantilever support formed of laminated composite elements having different elastic moduli.

2. The switch of claim 1 wherein said first cantilever support comprises a copper middle layer and ferrous outer layers which sandwich said middle layer.

3. In a hermetic type, thermally responsive switch including a cup-like vessel hermetically sealed by a cap, a fixed contact carried upon the free end of a first cantilever support disposed in said vessel, an elongated, second cantilever support disposed in said vessel, the fixed ends of said first and second cantilever supports being positioned at the same end of said vessel, a thermally responsive, disk-like element carried at one end by said second cantilever support and having on the other end a movable contact to engage with and disengage from said fixed contact when snapped by said disk-like element in response to temperature changes, the improvement which comprises having an aperture in said cap and a columnar terminal element fixed in air-tight, electrically insulated relationship through said aperture, the length of said terminal element being not more than twice as great as its diameter, the inner end of said terminal element being attached to said first cantilever support by means of surface to surface contact.

4. The switch of claim 1 wherein there is connecting means attached to the free end of said second cantilever support upon which said disk-like element at its said one end is fixed and spacer means is mounted between said connecting means and said second cantilever support in electrically and thermally relationship with said connecting means.

5. The switch of claim 4 wherein said spacer means comprises screw means threaded through a hole in said free end of said second cantilever support and there is electrical insulator means secured at one end to an end of said screw means and at the other end is engaged with said connecting means.

6. The switch of claim 5 wherein said connecting means has a crank-shaped configuration, the intermediate portion of which is of reduced width to allow for ready deformation.

* * * * *